US005467076A

United States Patent [19]

Ruocco et al.

[11] Patent Number: 5,467,076

[45] Date of Patent: Nov. 14, 1995

[54] REALTY SIGN LIGHTING/ANTI-THEFT ASSEMBLY

[76] Inventors: Rita Ruocco, 7123 Farralone Ave., #28, Canoga Park, Calif. 91303; Roger Hance, 19328 Singing Hills Dr., Northridge, Calif. 91326

[21] Appl. No.: 311,981

[22] Filed: Sep. 26, 1994

[51] Int. Cl.[6] ..... G08B 13/14

[52] U.S. Cl. ..... 340/571; 40/442; 40/560; 40/606; 40/611; 315/76; 340/540; 340/689; 340/693; 362/812; 455/66; 455/95; 455/899

[58] Field of Search ..... 340/571, 540, 340/689, 693; 455/66, 95, 899; 362/812, 183, 191; 40/442, 560, 559, 611, 606; 315/76

[56] References Cited

U.S. PATENT DOCUMENTS

| | | | |
|---|---|---|---|
| 3,192,517 | 6/1965 | Werlin | 340/689 |
| 4,319,310 | 3/1982 | Kingsley | 362/183 |
| 4,384,317 | 5/1983 | Stackpole | 362/183 |
| 4,410,930 | 10/1983 | Yachabach | 362/145 |
| 4,441,143 | 4/1984 | Richardson, Jr. | 362/183 |
| 4,481,562 | 11/1984 | Hickson | 362/183 |
| 4,484,104 | 11/1984 | O'Brien | 315/86 |
| 4,590,543 | 5/1986 | Chen | 362/183 |
| 4,718,185 | 1/1988 | Conlin et al. | 40/442 |
| 4,835,664 | 5/1989 | Wen | 362/183 |
| 5,101,329 | 3/1992 | Doyle | 362/183 |
| 5,153,561 | 10/1992 | Johnson | 340/571 |

*Primary Examiner*—Glen Swann
*Attorney, Agent, or Firm*—John J. Posta, Jr.

[57] ABSTRACT

The realty sign lighting and display assembly is in the form of a real estate standard having a vertical post and a horizontal cross-arm from which depends a display panel. The cross-arm is specially constructed to incorporate within it anti-theft and display components and components for powering the anti-theft display components. Thus, the cross-arm includes a solar panel, preferably at the top of the cross-arm, and a rechargeable battery connected to the solar panel. The battery powers one or more spot lights located in the bottom of the cross-arm and directed at the display panel below the cross-arm. The solar panel includes electrical heating elements which keep the solar panel free of snow. A thermal sensor may be disposed in the top of the cross-arm and be connected to a switch operating the solar panel. An alarm connected to the battery prevents theft of the cross-arm. Preferably, the alarm includes a pendulum switch activatable by moving the cross-arm. The switch may be connected to a programmable coder. The cross-arm also includes a continuous advertising tape broadcast by a radio transmitter in the cross-arm. A door bearing a lock in the cross-arm provides access to the components in the cross-arm.

10 Claims, 2 Drawing Sheets

REALTY SIGN LIGHTING/ANTI-THEFT ASSEMBLY

BACKGROUND OF THE INVENTION

1. Field of the Invention

The present invention generally relates to display means and more particularly to an improved real estate display standard which incorporates anti-theft means.

2. Prior Art

It is important in the selling and leasing of real estate that proper advertising be strategically positioned on or adjacent to the real estate site. This enables the location of the real estate to be identified easily and also conveys information concerning the real estate itself and the agent handling the leasing or sale of the real estate. Accordingly, it is common practice to erect a real estate standard which comprises a vertical post with a horizontal cross-arm from which depends an advertising panel bearing the desired information.

Unfortunately, many prospective buyers and lessees, because of business commitments, are unable to view the property except at night and if the display panel is unlighted will not obtain the desired infomation set forth on the display panel. In many cases it is difficult to provide the display panel with artificial lighting because of the absence of a close-by power source, Artificial lighting has the advantage of rendering the property to be leased or sold easy to locate at night and attractive to even casual drive-by viewers.

Accordingly, there remains a need for an improved type of real estate display standard which incorporates suitable artificial lighting means and which, because of the current crime wave rampant in most sections of the U. S., also has effective means of preventing theft of the standard. The standard should be compact, light in weight, durable, easily movable from one location to another and easy to install and remove.

SUMMARY OF THE INVENTION

The improved realty sign lighting and display assembly of the present invention satisfies all the foregoing needs. The assembly is substantially as set forth in the ABSTRACT OF THE DISCLOSURE.

Thus, the assembly is an improved real estate standard having a vertical post and horizontal cross-arm from which depends a real estate display panel. The cross-arm is specially constructed to wholly incorporate within it anti-theft and display components, including lighting means and means for powering the various components within the cross-arm.

The cross-arm has a solar panel, preferably located at the top of the cross-arm for full exposure to the sun, and a battery rechargeable by the panel. The battery(s), in turn, powers one or more spot lights, preferably located at the bottom of the cross-arm and positioned to shine down and light up the depending display panel for full viewing.

The solar panel includes one or more electrical heating coils connected to the battery and to a switch, with or without a thermal sensor. The heating elements adapted to keep the solar panel free of snow and thus fully operative, even in the wintertime.

The anti-theft components within the cross-arm detect movement of the cross-arm and include an alarm operated by the battery and preferably include a pendulum-type motion detection switch. They may also include a programmable coder connected to the alarm switch, so that the switch and thus the alarm can only be turned off by a person knowing the code set for the alarm.

A further feature of the cross-arm is a radio transmitter bearing a continuous play tape having audio advertising thereon. The advertising can be heard by having a radio such as a prospective customer's car radio, tuned to a certain frequency, as listed in instructions on the advertising panel which forms part of the real estate standard. This enables specific information concerning the property being offered for sale or lease to be given to the prospective customer while he or she is viewing the property.

A door bearing a lock forms part of the cross-arm and provides access to the above-mentioned components in order to service and replace them, when necessary, and to activate and inactivate the various switches of the assembly.

It should be noted that all components are located within the horizontal cross-arm, thereby providing a compact unit that can be moved from one location to another, if desired, merely by detaching it from the vertical post. The compact assembly is relatively theft-proof and resists contamination from the environment.

If desired, some or all of the components preferably disposed within the horizontal cross-arm could be located within the vertical post.

Further features of the improved realty sign anti-theft display assembly are set forth in the following detailed description and accompanying drawings.

DRAWINGS

DETAILED DESCRIPTION

Figure 1:
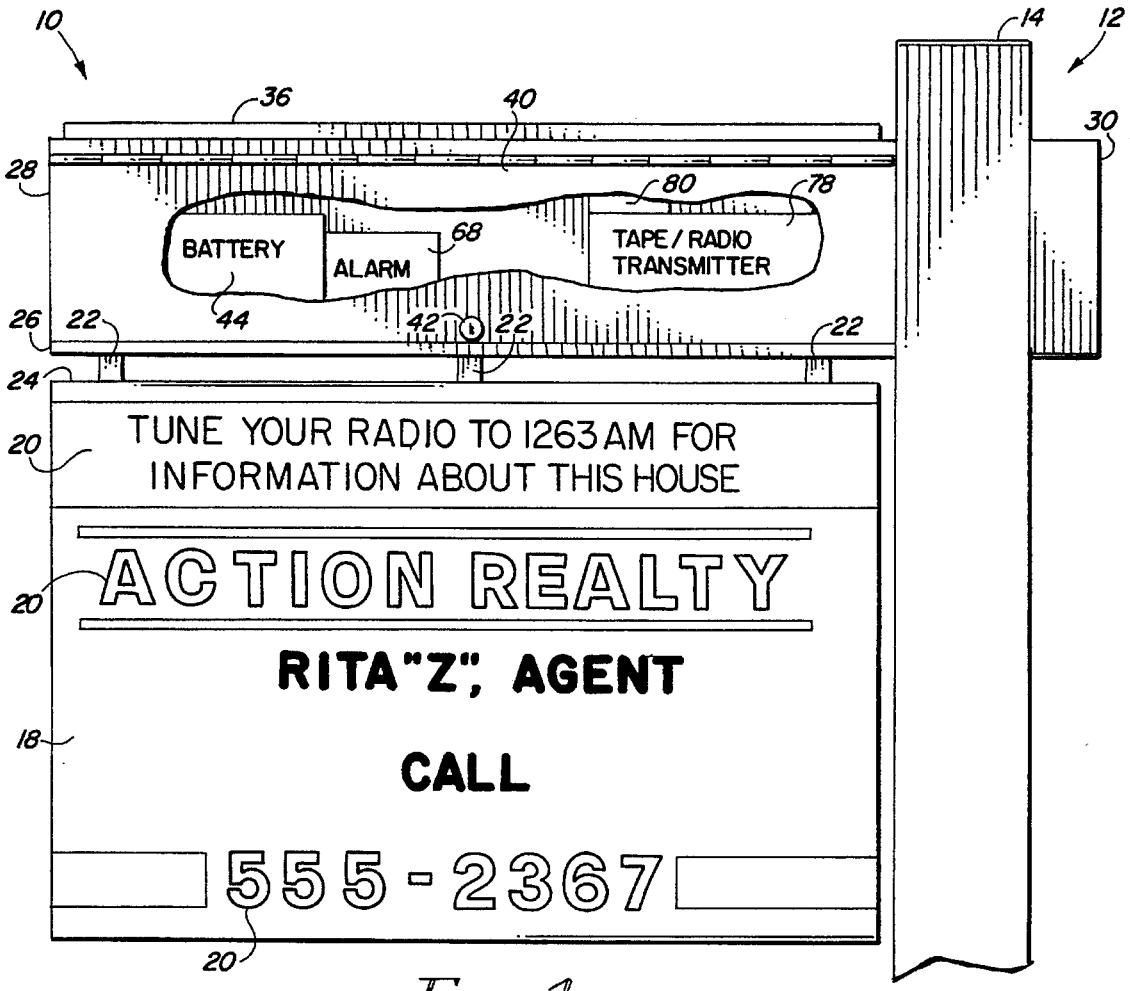
FIG. 1 is a schematic fragmentary side elevation, partly broken away, of a preferred embodiment of the improved real estate sign anti-theft and display assembly of the present invention, illustrating internal components of the cross-arm of the assembly.
Figure 2:
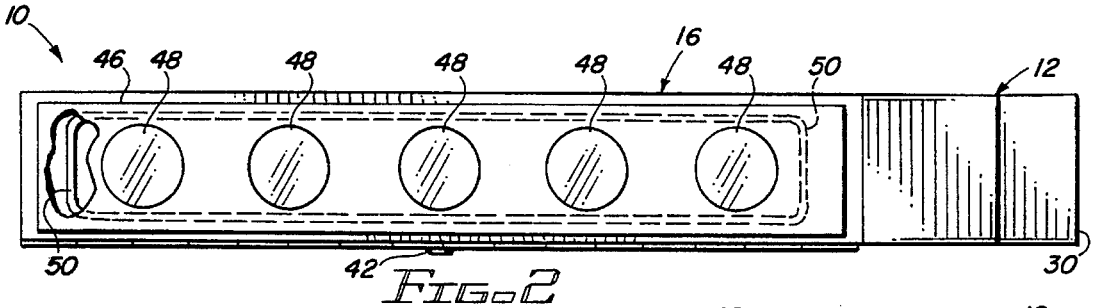
FIG. 2 is schematic top plan view of the cross-arm of the assembly of FIG. 1.
Figure 3:
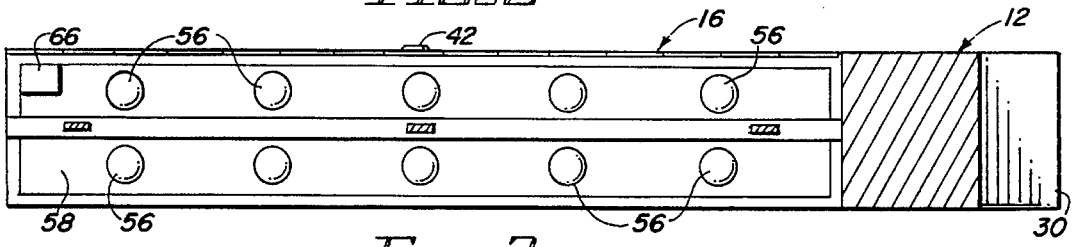
FIG. 3 is a schematic bottom plan view of the cross-arm of the assembly of FIG. 1.

Now referring more particularly to FIGS. 1–7 of the drawings, a preferred embodiment of the improved realty sign anti-theft display assembly of the present invention is schematically set forth therein.

Thus, assembly 10 is shown which comprises a real estate standard 12 having a vertical post 14, the lower end of which is adapted to be temporarily seated in the ground adjacent a real estate property to be sold or leased or rented. The standard 12 also includes a horizontal cross-arm 16, from the underside of which depends a preferably detachable display panel 18 bearing advertising indicia 20. Panel 18 is connected to cross-arm by struts or links 22 secured to the top 24 of panel 18 and the bottom 26 of cross-arm 16.

Cross-arm 16 is elongated and preferably generally rectangular with closed opposite ends 28 and 30, vertical opposite sides 32 and 34 and bottom 26 and top 36 collectively defining a central space 38, access to which is made through a hinged door 40 in sides 34 thereof. A lock 42 releasably secures door 40 in the closed position to side 34.

Door 40 provides access to a plurality of components disposed within space 38. Thus, space 38 includes a rechargeable battery 44 electrically to a solar panel 46 which closes top 36. Panel 46 comprises a plurality of spaced solar units 48 around which are disposed in panel 46 one or more electrical resistance heating coils 50 connected to battery 44. Heating coils 50 operate to keep panel 46 cleared of snow and thus operable even in snowy weather.

Figure 5:
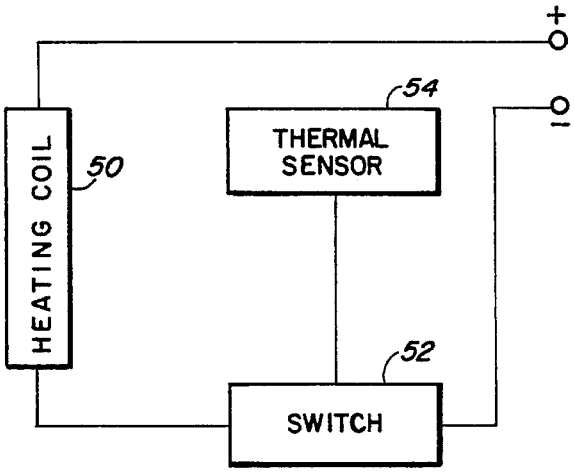
FIG. 5 is a schematic diagram of the heating coil, thermal sensor and switch array utilized in the assembly of FIG. 1.

As shown schematically in FIG. 5, heating coil 50 is connected to an on-off switch 52 so it can be inactivated in the spring, summer and fall. Optionally, as shown in FIG. 5, heating coil 50 may also be regulated by a thermal sensor 54 running to switch 52 and causing it to move into the "on" position when the temperature sensed by sensor falls to below a predetermined level.

One or a plurality of spot lights, flood lights or the like, generally designated by the numeral 56, are disposed in a panel 58 in the otherwise open bottom 26 of cross-arm 16, sealing bottom 26. Lights 56 are trained on display panel 18, illuminating it. Lights 56 are powered by battery 44. An on-off switch 60 controls the flow of electricity to lights 56 from battery 44. Switch 60 can be manually set, as by lever 62, or can be programmed to operate in a controlled manner, as by timer 64 connected thereto. Switch 60 can also be controlled by an optional light sensor 66 positioned in panel 58.

Figure 4:
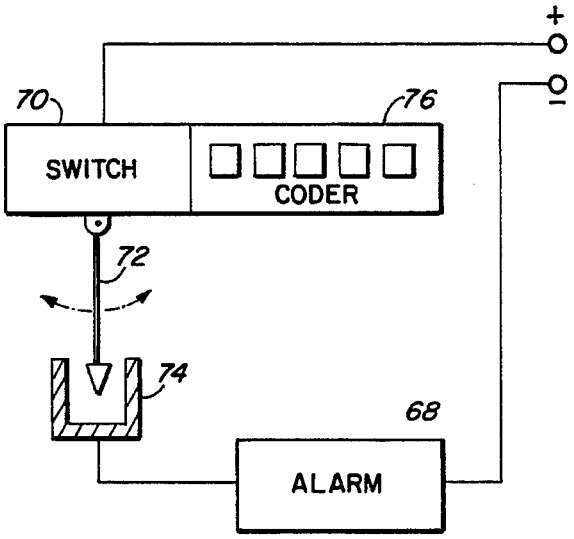
FIG. 4 is a schematic diagram of the pendulum-type alarm utilized in the assembly of FIG. 1.
Figure 6:
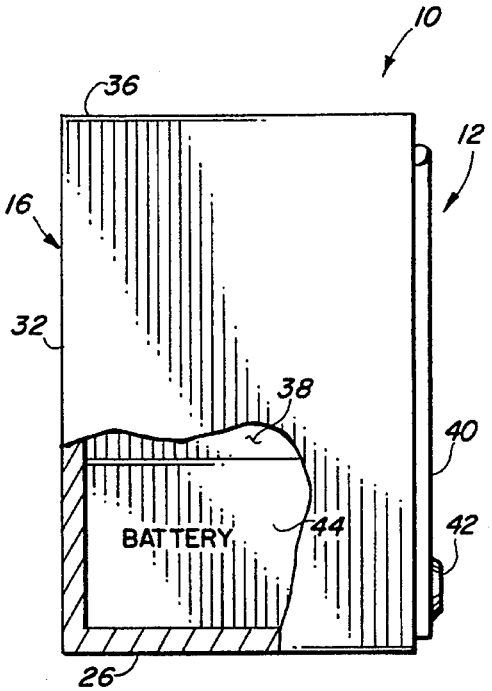
FIG. 6 is an enlarged schematic end view, partly broken away, of the cross-arm of the assembly of FIG. 1.
Figure 7:
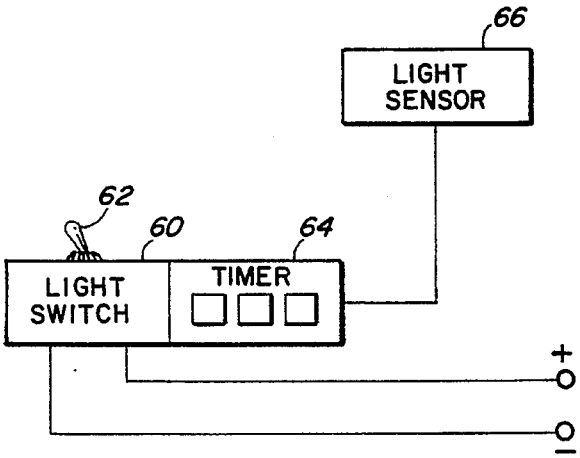
FIG. 7 is a schematic diagram of the light switch, timer and light sensor array utilized in the assembly of FIG. 1.

An alarm array assures that standard 12 cannot be moved without detection. Movement of standard 12 sets off an alarm 68 connected to and powered by battery 44. Thus, alarm 68 is classified as of the motion-detecting type. A typical form of alarm 68 is shown schematically in FIG. 4. Thus, alarm 68 in FIG. 4 is connected to a switch 70 which is of the pendulum type, having a depending swinging pendulum arm 72 which closes the circuit to alarm 68 when standard 12 or even only cross-arm 16 is tilted from its erected position. Pendulum arm 72 is spaced within a generally U-shaped contact 74, as shown in FIG. 7. Switch 70 also may include a programmable coder 76 which assures that switch 70 and thus alarm 68 can also be deactivated by a person entering in coder 76 the proper deactivating code. Alarm 68 prevents undetected tampering with assembly 10, thus assuring its safety. If desired, alarm 68 can be constructed to send a signal to a receiving station to indicate when alarm 68 is set off.

Assembly 10 also includes in cross-arm 16 a radio transmitter 78 whch broadcasts at a predetermined radio frequency on a continuous basis an advertising message contained on a continuous tape 80 in transmitter 78. Transmitter 78 is powered by battery 44. If desired, transmitter 78 can be connected to alarm 68 so that transmitter 78 can be used to broadcast the previously mentioned signal, indicating alarm 68 has been set off. Instructions on panel 18 to have the prospective customer tune his or her radio to a frequency which picks up the endless tape message enable the prospective customer to receive substantial information about the property being viewed by the prospective customer at standard 12.

It will be understood that battery 44, solar panel 46, heating coil(s) 50, lights 56, alarm 68 and radio transmitter 78 are within and form part of cross-arm 16, yet are accessible through door 40, as needed. Thus, cross-arm 16 forms an entirely self-contained unit which can be removed from post 14 or can be made a permanent non-removable part thereof.

Standard 12 can be fabricated of any suitable conventional materials and cross-arm 16 thereof can employ any conventional rechargeable battery 44 capable of being recharged by conventional solar panel 46. Moreover, heating coil(s) 50 can be of a conventional type, as can alarm 68 with motion-detecting switch 70, as well as radio transmitter 78.

Assembly 10 is durable, light in weight, efficient for its intended purposes and reutilizable at a number of locations. Accordingly, it has the optimal qualities needed for improved on-site real estate advertising.

As previously noted, one or more of the components shown in the drawings which are located within the horizontal cross-arm 16 could, if desired, be located within the standard 12 without departing from the scope of the invention. Likewise, other types of broadcasting devices might be employed including digital recording devices or other similar digital message transmitting means.

What is claimed is:

1. An improved realty sign lighting and display assembly, said assembly comprising, in combination:

a) a real estate standard having a vertical post and a horizontal cross-arm and a display panel depending from said cross-arm; and, b) anti-theft/display means incorporated in said cross-arm, comprising:

i) a solar panel;

ii) a rechargeable battery connected to said solar panel;

iii) light means connected to said battery and directed toward said depending display panel;

iv) electric heating means connected to said battery and disposed adjacent said solar panel for heating said panel to remove snow therefrom;

v) alarm means connected to said battery and activatable by movement of said cross-arm; and, vi) an access door in said cross-arm for servicing said light means and said alarm means, said door being secured by a lock.

2. The improved realty sign assembly of claim 1 wherein said alarm means includes an on-off switch connected to and activatable through code means in said cross-arm.

3. The improved realty sign assembly of claim 2 wherein said alarm comprises a pendulum switch arm activatable by tilting said cross-arm.

4. The improved realty sign assembly of claim 1 wherein said light means includes at least one spot light directed downwardly towards said display panel.

5. The improved realty sign assembly of claim 1 wherein said assembly includes in said cross-arm a radio transmitter incorporating a continuously broadcasting advertising audio tape, said radio being connected to said battery.

6. The improved realty sign assembly of claim 1 wherein said solar panel is located in the top of said cross-arm and wherein said light means is disposed in the bottom of said cross-arm.

7. An improved sign and display assembly, comprising:

a) a display panel;

b) support means for said display panel; and, c) a self-contained lighting system disposed within said support means for illumuniating said display panel comprising:

i) a solar panel;

ii) a rechargeable battery connected to said solar panel; and, iii) light means connected to said battery and directed toward said display panel to illuminate it.

8. The display assembly of claim 7 wherein said support means also has electric heating means connected to said battery and disposed adjacent said solar panel for heating said panel to prevent snow or ice from accumulating thereon.

9. An improved realty communication device for providing information on a house for sale to passing motorists, comprising:

a) a real estate standard located near said house; and b) message transmitting means located entirely within said standard adapted to transmit information on said house to passing motorists.

10. The communication device of claim 9, including a solar panel and rechargeable battery all interconnected to said message transmitting means and all located entirely within said standard.

* * * * *